US007122950B2

(12) United States Patent
Lee et al.

(10) Patent No.: US 7,122,950 B2
(45) Date of Patent: Oct. 17, 2006

(54) CATHODE RAY TUBE HAVING MAGNETIC PIECES AT PREDETERMINED LOCATIONS WITHIN THE ELECTRON GUN COMPONENTS

(75) Inventors: Soo Keun Lee, Gyeongsangbook (KR); Duck Su Kim, Gyeongsangbook (KR); Jeong Geung Lee, Gyeongsangbook (KR)

(73) Assignee: LG.Philips Displays Korea Co., Ltd., Gyeongsangbuk-do (KR)

( * ) Notice: Subject to any disclaimer, the term of this patent is extended or adjusted under 35 U.S.C. 154(b) by 293 days.

(21) Appl. No.: 10/676,097

(22) Filed: Oct. 2, 2003

(65) Prior Publication Data

US 2005/0225225 A1 Oct. 13, 2005

(30) Foreign Application Priority Data

Oct. 2, 2002 (KR) ..... 10-2002-0060343
Nov. 16, 2002 (KR) ..... 10-2002-0071429

(51) Int. Cl.
*H01J 29/46* (2006.01)
*H01J 29/58* (2006.01)
*H01J 29/48* (2006.01)

(52) U.S. Cl. ..... 313/433; 313/412; 313/413; 313/414; 313/439

(58) Field of Classification Search ..... 313/412, 313/432–439
See application file for complete search history.

(56) References Cited

U.S. PATENT DOCUMENTS 4,457,733 A * 7/1984 Gioia et al. ..... 313/413
4,725,757 A 2/1988 Pieri et al.
2001/0030502 A1* 10/2001 Kwon et al. ..... 313/412

FOREIGN PATENT DOCUMENTS

JP 05174725 A * 7/1993
JP 10-116570 5/1998
KR 091-12994 7/1991
KR 2001-91314 10/2001
KR 20010091314 A 10/2001

* cited by examiner

*Primary Examiner*—Mariceli Santiago
(74) *Attorney, Agent, or Firm*—McKenna Long & Aldridge LLP

(57) ABSTRACT

The present invention relates to a color cathode ray tube and electron gun, and more particularly, to a color cathode ray tube and electron gun to improve deflection aberration efficiently using magnetic material formed at the electron gun and to improve a resolution of a display screen.

9 Claims, 14 Drawing Sheets

CATHODE RAY TUBE HAVING MAGNETIC PIECES AT PREDETERMINED LOCATIONS WITHIN THE ELECTRON GUN COMPONENTS

This application claims the benefit of Korean Patent Application Nos. 2002-60343 and 2002-71429 filed on Oct. 2, 2002 and Nov. 16, 2002, which is hereby incorporated by reference for all purposes as if fully set forth herein.

BACKGROUND OF THE INVENTION

1. Field of the Invention

The present invention relates to a color cathode ray tube and an electron gun, and more particularly, to a color cathode ray tube and an electron gun in which the deflection aberration is efficiently improved by using a magnetic material formed at the electron gun, and the resolution of a display screen is also improved.

2. Description of the Related Art

FIG. 1 illustrates the configuration of a color cathode ray tube according to the related art.

Referring to FIG. 1, the color cathode ray tube of the related art is a kind of vacuum tube that includes a panel 1 placed at a front glass and a funnel 2, which is a rear glass, sealed and coupled with the panel 1 so that the flat color cathode ray tube has a vacuum inside.

Red, blue and green (R, G and B) fluorescent materials are coated on an inner surface of the panel 1 to form a fluorescent screen 11. An electron gun 8 is installed at a neck portion of the funnel 2 opposite to the fluorescent screen 11.

A shadow mask 3 to select colors is installed between the fluorescent screen 11 and the electron gun 8, and spaced by a predetermined distance from the fluorescent screen 11. The shadow mask 3 is coupled with a mask frame 4, elastically supported by a spring 5, and supported on the panel 1 by a stud pin 6. In addition, the mask frame 4 is coupled with a magnetic inner shield 7 to reduce the effect of the earth magnetic field at the rear of the cathode ray tube to reduce the movement of electron beam 6 caused by external magnetic field.

Meanwhile, a convergence purity correction magnet (CPM) 10 is installed at a neck portion of the funnel 2 to control an RGB electron beam so that the electron beam is converged on one spot. In addition, a reinforcement band 12 is installed to strengthen the front glass against the internal vacuum.

The operation of the color cathode ray tube configured as described above will be described. The electron beam emitted from the electron gun 8 is deflected in vertical and horizontal directions by the deflection yoke 9. The deflected electron beam passes a beam passage hole of the shadow mask 3 and collides with the front fluorescent screen 11 to display a desired color image. Here, a convergence purity correction magnet 10 corrects the convergence and purity of the R, G and B electron beams, and an inner shield 7 shields the electron beams from the effects of the earth magnetic field at the rear of a cathode ray tube.

FIG. 2 illustrates the configuration of an electron gun according to the related art. An electron gun 8 includes three cathodes 80 independent from each other, a first electrode (GI) 81 installed separated from the cathode 80 at a predetermined distance, a second electrode (G2) 82 spaced from the first electrode (G1) 81 at a predetermined distance, a third electrode (G3) 83 spaced from the second electrode (G2) 82 with a predetermined distance, a fourth electrode (G4) 84 spaced from the third electrode (G3) 83 at a predetermined distance, a fifth electrode (G5) 85 spaced from the fourth electrode (G4) 84 at a predetermined distance, a sixth electrode (G6) 86 spaced from the fifth electrode (G5) 85 at a predetermined distance, and shield cup 87.

The deflection yoke 9 that deflects an electron beam across the entire screen is installed at an outer side of the neck portion of the funnel 2 having an electron gun 8. Here, a ground voltage is applied to the first electrode 81. A static voltage of about 600 V is applied to the second electrode 82 and the fourth electrode 84. A dynamic focus voltage is applied to the third electrode 83 and the fifth electrode 85. A static voltage of about 26000 V is applied to the sixth electrode 86.

Operation of an electron beam will be described referring to the configuration described above. The amount of hot electrons emitted from a hot heater is controlled by the first electrode 81 and the hot electrons are accelerated by the second electrode 82. The hot electrons pass through the third electrode 83, the fourth electrode 84, the fifth electrode 85 and the sixth electrode 86 in series that are converging electrodes so that the hot electrons are converged and accelerated finally to collide with the screen.

These R, G and B electron beams converge on the center of the screen by a static convergence operation of a main lens. If three electron beams are deflected away from the center of the screen using a uniform magnetic field, the three electron beams focus before they reach the screen and they deviate with each other because of the distance between the electron guns and the screen.

To overcome this problem without any additional circuitry, a self-convergence magnetic field is used. The self-convergence magnetic field is formed to be a pincushion type field horizontally and to be barrel type field vertically.

FIG. 3 illustrates a self-convergence magnetic field. The R, G and B electron beams arranged inline are converged on the screen without any additional dynamic convergence because a self-convergence magnetic field consists of a pincushion type horizontal deflection magnetic field (HB) and a barrel type vertical deflection magnetic field (VB).

However, as shown in FIG. 4, the cross-sections of R and B electron beams positioned at the ends of three electron beams arranged inline are distorted because the density of the magnetic field formed by the deflection yoke gets dense as it travels from the center portion to the peripheral portion. Accordingly, to improve the focus at the periphery of the screen, a dynamic focus voltage should be applied to each of electron beams, but the focus of the R and B electron beams deteriorates because the same dynamic focus voltage is applied to the three electron beams in an inline electron gun in which a passage hole for R, G and B three electron beams is formed from one electrode.

FIG. 5 illustrates a pincushion type horizontal deflection magnetic field. The three electron beams are deflected by a pincushion type horizontal deflection magnetic field (HB) as shown in FIG. 5 that forms a self-convergence magnetic field along with a barrel type vertical deflection magnetic field (VB) to converge to one point.

However, the electron beams are distorted by self-convergence magnetic field. Especially, the R, G and B electron beams are affected by focusing forces in different vertical directions at the left and right sides of the screen. Accordingly, on the right side of the screen, a haze in which the red electron beam gets blurry is caused, and a haze of the blue beam is caused on the left side of the screen so that the resolution degenerates on the entire screen.

FIG. 6 illustrates the pincushion magnetic field caused by a deflection yoke in a shield cup of an electron gun and the force applied to the electron beam. For example, supposing that the electron beam is emitted forward out of the figure towards the reader, if the magnetic field is directed upwards, the three electron beams are affected by the force in a direction to the right. However, as shown in FIG. 6, the red electron beam is affected by the divergent force in a direction orthogonal to the magnetic field and the blue electron beam is affected by the convergent force in a direction orthogonal to the magnetic field according to the form of the pin-cushion type horizontal deflection magnetic field so that a blooming phenomenon is caused by the red electron beam and a halo phenomenon is caused by the blue electron beam on the left side of the screen. In contrast, a halo phenomenon is caused by the red electron beam and a blooming phenomenon is caused by the blue electron beam on the right side of the screen.

FIGS. 7*a*, 7*b*, and 7*c* illustrate that the cross-sections of the R and B electron beams on both edges of R, G and B electron beams arranged inline are distorted.

FIG. 7*a* illustrates a pincushion type magnetic field of a deflection yoke when the electron beams are deflected to the left side of the screen. FIG. 7*b* illustrates that the B beam causes a halo phenomenon when deflected to the left of the screen. FIG. 7*c* illustrates that the R beam causes a blooming phenomenon when deflected to the left of the screen. In other words, as shown in FIG. 7*a*, the R and B electron beams undergo a force in the direction of the arrow mark on the drawing because of the pin-cushion type magnetic field of the deflection yoke. The B electron beam undergoes a force of the converging magnetic field and the R electron beam undergo a force of the diverging magnetic field.

As a result, when deflected in the left direction, the R electron beam causes a blooming phenomenon since lenses are formed as shown in FIG. 7*b* and the B electron beam causes a halo phenomenon since lenses are formed as shown in FIG. 7*c*. In contrast, the phenomena are switched when the electron beams are deflected in the right direction.

The halo phenomenon and the blooming phenomenon for the R and B electron beams increase and the size of the electron beams on the fluorescent screen vary as they scan to the periphery of the screen. This non-uniform cross-section of the electron beam deteriorates resolution of image. An electron gun that reduces coma aberration has been suggested to solve this problem.

For example, Japan Open Laid Application No. 10-116570 discloses that the deflection aberration is corrected using a magnetic piece for a portion of an electrode of the electron gun and using a separate magnetic field generating means synchronized with the deflection signal. However, this solution is more expensive, and it is difficult to manufacture because a separate magnetic field generating means is installed on the outer portion of the neck and a signal synchronized with deflection is applied to the magnetic field generating means while a magnetic piece is installed in the electron gun. Because the separate magnetic field generating means installed on the outer portion of the neck is synchronized with the deflection of the deflection yoke and is coupled with the deflection yoke, the deflection sensitivity of the deflection yoke is decreased so that power consumption is increased and additional heat is generated. So, this solution is difficult to apply.

Korean Laid-Open Patent Publication No. 2001-0091314 discloses that a deflection aberration is improved using a magnetic field created by a magnetic piece installed at the electron gun and the deflection yoke so that it is easy to apply the magnetic field. However, leakage magnetic field is not used enough since a small magnetic piece is disposed between an outer beam passage hole and a center passage hole.

In addition, another method has been studied in which an astigmatism lens is installed in the area of the electrode that constitutes a provisional converging lens to form a uniform electron beam cross-section across the entire fluorescent screen. The aspects of the first electrode of the electron beam and the electron beam passage hole of the second electrode are formed to be different from each other to prevent the electron beam which lands on the center and the periphery of the fluorescent screen from being distorted. However, it is very difficult to manufacture and control this astigmatism lens.

SUMMARY OF THE INVENTION

Accordingly, the present invention is directed to a color cathode ray tube and electron gun that substantially obviates one or more problems due to limitations and disadvantages of the related art.

An advantage of the present invention is to provide a color cathode ray tube and electron gun, and more particularly, to a color cathode ray tube and electron gun to improve deflection aberrations efficiently using a magnetic material formed at the electron gun and to improve the resolution of a display screen.

Additional features and advantages of the invention will be set forth in part in the description which follows, and in part will become apparent from the description, or may be learned from practice of the invention. These and other advantages of the invention may be realized and attained by the structure particularly pointed out in the written description and claims hereof as well as the appended drawings.

To achieve these and other advantages and in accordance with the purpose of the invention of the present invention, as embodied and broadly described herein, there is provided an electron gun for a color cathode ray tube. The electron gun includes: a cathode that emits electron beams; a plurality of electrodes arranged from the cathode towards a screen of the cathode ray tube; and a shield cup, wherein the shield cup further comprises: a central electron beam hole; two outer electron beam holes wherein the central and outer beam holes are substantially collinear along a horizontal axis; and first, second, third, and fourth magnetic pieces; wherein the first and second magnetic pieces are adjacent to a first outer electron beam hole and on opposite sides of the horizontal axis; and wherein the third and fourth magnetic pieces are adjacent to a first outer electron beam hole and on opposite sides of the horizontal axis.

In another aspect of the present invention, there is provided an electron gun for a color cathode ray tube. The electron gun includes: a cathode that emits electron beams; a plurality of electrodes arranged from the cathode towards a screen of the cathode ray tube; and a shield cup, wherein the shield cup further comprises: a central electron beam hole; a first and second outer electron beam holes wherein the central and outer beam holes are substantially collinear along a horizontal axis; and first and second magnetic pieces; wherein the first and second magnetic pieces are on opposite sides of the horizontal axis and extend such that a portion the first and second outer electron beam holes are between the first and second magnetic pieces.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to an 676666 embodiments of the present invention, example of which is illustrated in the accompanying drawings. Wherever possible, the same reference numbers will be used throughout the drawings to refer to the same or like parts.

Figure 8:
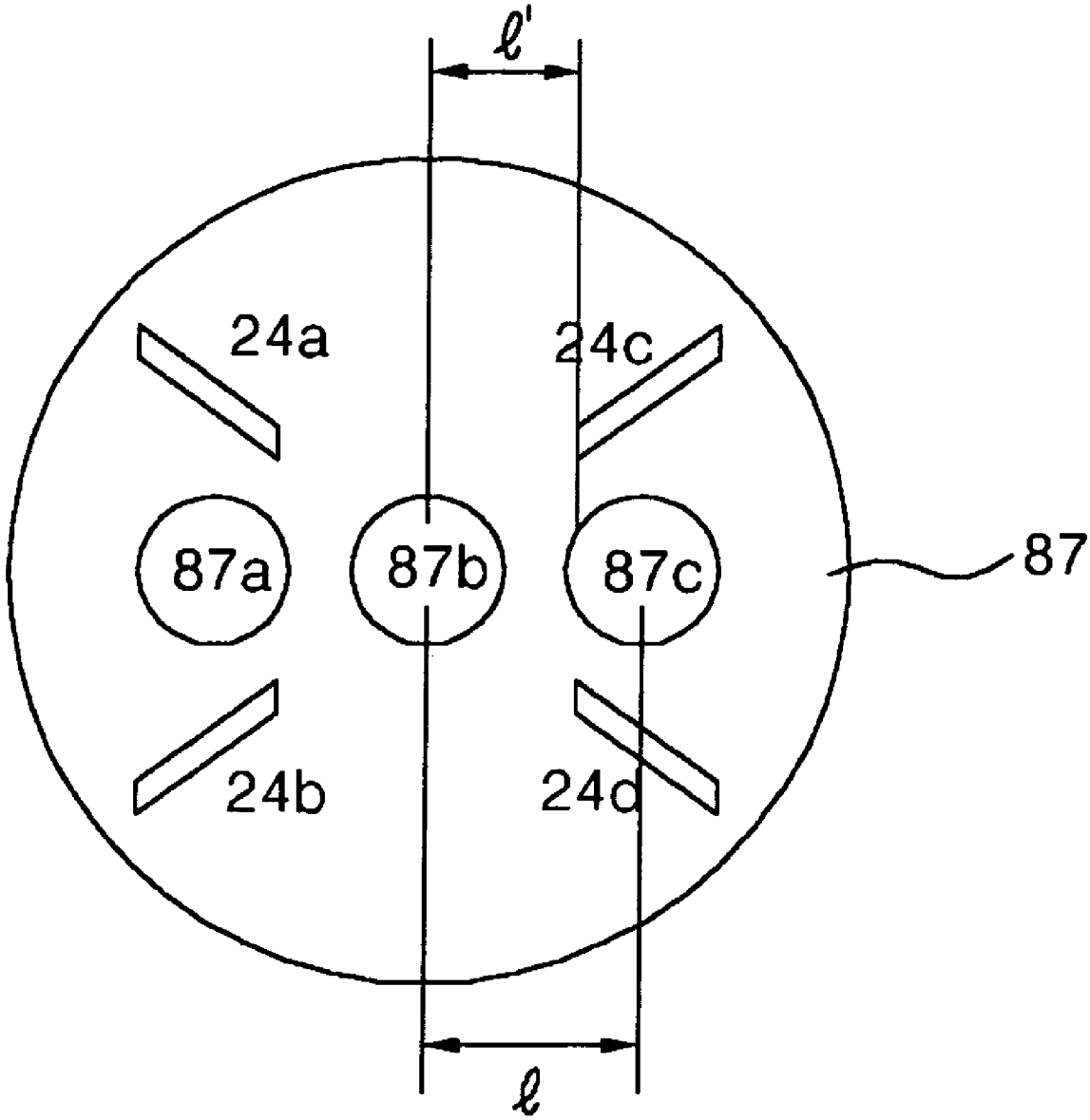
FIG. 8 illustrates a first embodiment of the present invention.

FIG. 8 illustrates a first embodiment of the present invention. An electron gun for an inline type color cathode ray tube according to the present invention comprises a cathode for emitting electron beams, a plurality of electrodes disposed successively in a direction from the cathode to a screen and a shield cup, wherein a location of the vertically closest place between paired magnetic pieces placed at the above and below a outer beam path of the shield cup or at least one of the plurality of electrodes is between the center of a center beam passage hole and the center of an outer beam passage hole.

Described in further detail, magnetic pieces 24*a*, 24*b*, 24*c* and 24*d* are installed symmetrically above and below the outer beam passage holes 87*a* and 87*c* of the three electron beam passage holes 87*a*, 87*b* and 87*c* formed on the surface of the shield cup 87. Here, the left-right or horizontal direction is defined as the direction of the line connecting the centers of the three electron beam passage holes 87*a*, 87*b* and 87*c*. The above-below or vertical direction is the direction perpendicular to the left-right or horizontal direction. The magnetic pieces have first ends that may be disposed close to each other in the vertical direction in the area near the center beam passage hole 87*b*. The magnetic pieces have second ends that are disposed vertically comparatively far from each other in the vertical direction, where the second end is opposite the first end and further from the center beam passage hole 87*b* than the first end. The first ends of the magnetic pieces 24*a*, 24*b*, 24*c* and 24*d* may be located closer to the centers of the outer beam passage holes 87*a* and 87*c* than to the center of the center beam passage hole 87*b*.

The magnetic pieces 24*a*, 24*b*, 24*c* and 24*d* may have a substantially rectangular shape and may be slanted by 18 to 57 degrees with respect to the horizontal direction. The magnetic pieces 24*a*, 24*b*, 24*c* and 24*d* are tilted so that a barrel type magnetic field is formed to remove a haze phenomenon. In addition, when the magnetic pieces 24*a*, 24*b*, 24*c*, and 24*d* have a substantially rectangular shape and are slanted with respect to the horizontal direction by 20 to 23 degrees, the haze phenomenon is removed and the convergence problem is overcome. It is desirable to have the magnetic pieces 24*a*, 24*b*, 24*c* and 24*d* extend to the outer beam passage hole and exceed the center of the outer beam passage hole.

In general, due to static convergence of a main lens, an outer electron beam is shifted from the center of the outer beam passage hole towards an edge of the hole towards the center beam passage hole when passing the shield cup 87.

FIG. 8 shows a distance l between the center of the center beam passage hole 87*b* and the center of an outer beam passage hole 87*a* or 87*c*, and l' is a distance between the center beam passage hole 87*b* and the first end of the magnetic piece 24*a*, 24*b*, 24*c* and 24*d*. It is desirable to for l'/l to be $$0.5 \le \frac{l'}{l} \le 1.0.$$

When l'/l is less than 0.5, the effect of the magnetic pieces 24*a*, 24*b*, 24*c* and 24*d* are so small that the haze phenomenon cannot be corrected. And when l'/l is greater than 1.0 and the electron beams are deflected to the right side, the convergence of the red electron beam is enhanced vertically and divergence of the blue electron beam is enhanced vertically causing more haze phenomenon because the field between the magnetic pieces aligns with the pincushion field.

Figure 9:
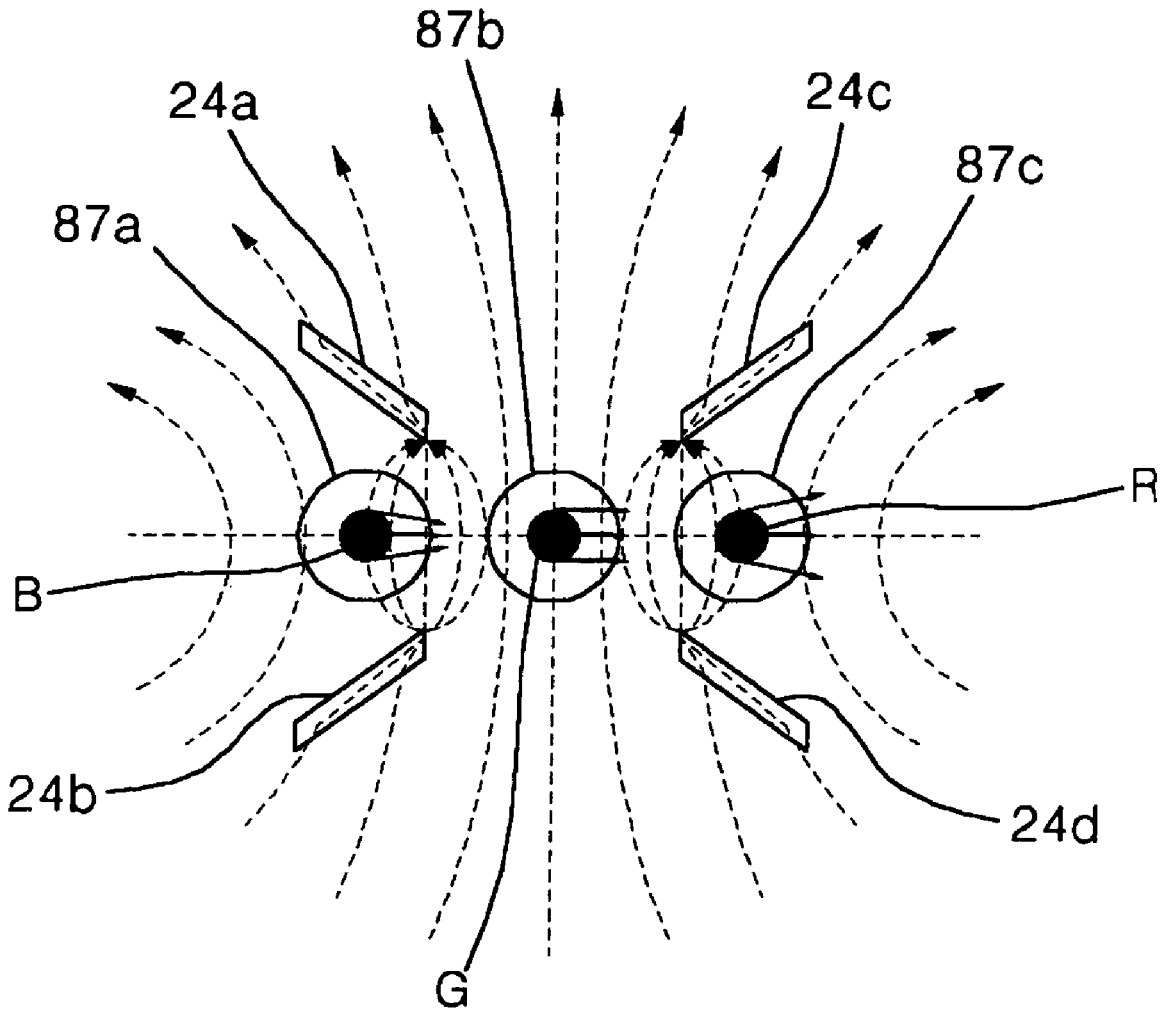
FIG. 9 illustrates the variation of a magnetic field in the first embodiment of the present invention.

FIG. 9 illustrates the variation of the magnetic field in the first embodiment of the present invention. A general magnetic material has specific permeability of 1000 or more. A nonmagnetic material and vacuum have a specific permeability of 1 to 2 and 1 respectively. So, almost all of the magnetic flux flows in the magnetic material. In the present invention, the desired correction effect can be obtained when the specific permeability is set to be 5 or more.

Referring to FIG. 9, the magnetic flux which flows above and below the outer electron beam holes 87*a* and 87*c* is drawn in by and flows through the magnetic pieces 24*a*, 24*b*, 24*c* and 24*d* above and below the outer electron beam holes 87*a* and 87*c*. The magnetic flux outside the magnetic pieces flows in the path that has the least magnetic resistance, that is, the path closest to the magnetic pieces. Accordingly, the pincushion type magnetic field rarely exists in the outer beam passage holes 87*a* and 87*c*. There is a barrel type magnetic flux created by the magnetic pieces in the paths of the electron beams of the outer beam passage holes 87*a* and 87*c* closest to the center beam passage hole 87*b*. In addition, the magnetic pieces extend to the outer beam passage holes 87*a* and 87*c* and beyond the center of the outer beam passage holes 87*a* and 87*c*. The magnetic pieces are slanted with respect to the horizontal axis and have a predetermined angle with respect to the magnetic flux created by the deflection yoke so that the high density magnetic flux is created closest to the upper and lower magnetic pieces.

Figure 6:
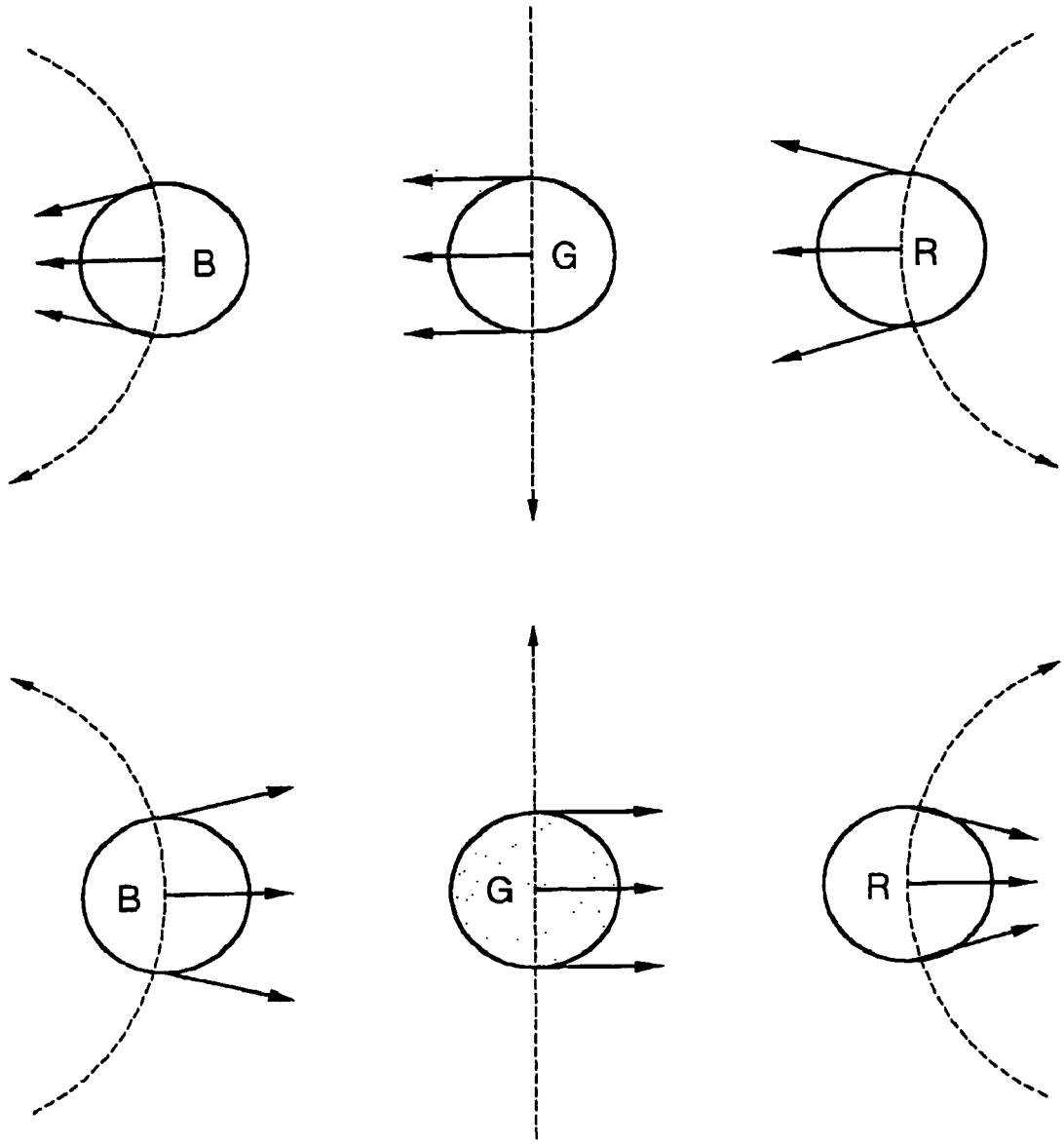
FIG. 6 (Related Art)
FIG. 6 illustrates a pin-cushion magnetic field caused by a deflection yoke in a shield cup of an electron gun and a force applied to the electron beam.

In FIG. 6, the red electron beam affected by the pincushion type horizontal deflection magnetic field is over-converged when deflected to the right side of the screen. The blue electron beam affected by the pincushion type horizontal deflection magnetic field is not converged enough when deflected to the right side of the screen. However, the barrel type horizontal deflection magnetic field shown in FIG. 9 compensates for these effects.

As described above, the path of the magnetic flux passing through the outer beam passage holes 87*a* and 87*c* is changed to suppress the pin-cushion type magnetic flux in the outer beam passage holes 87*a* and 87*c*, and the strong barrel type magnetic flux in the outer beam passage holes 87*a* and 87*c* is created using the magnetic flux converged by the magnetic pieces. As a result, the deflection aberration may be corrected.

Figure 10:
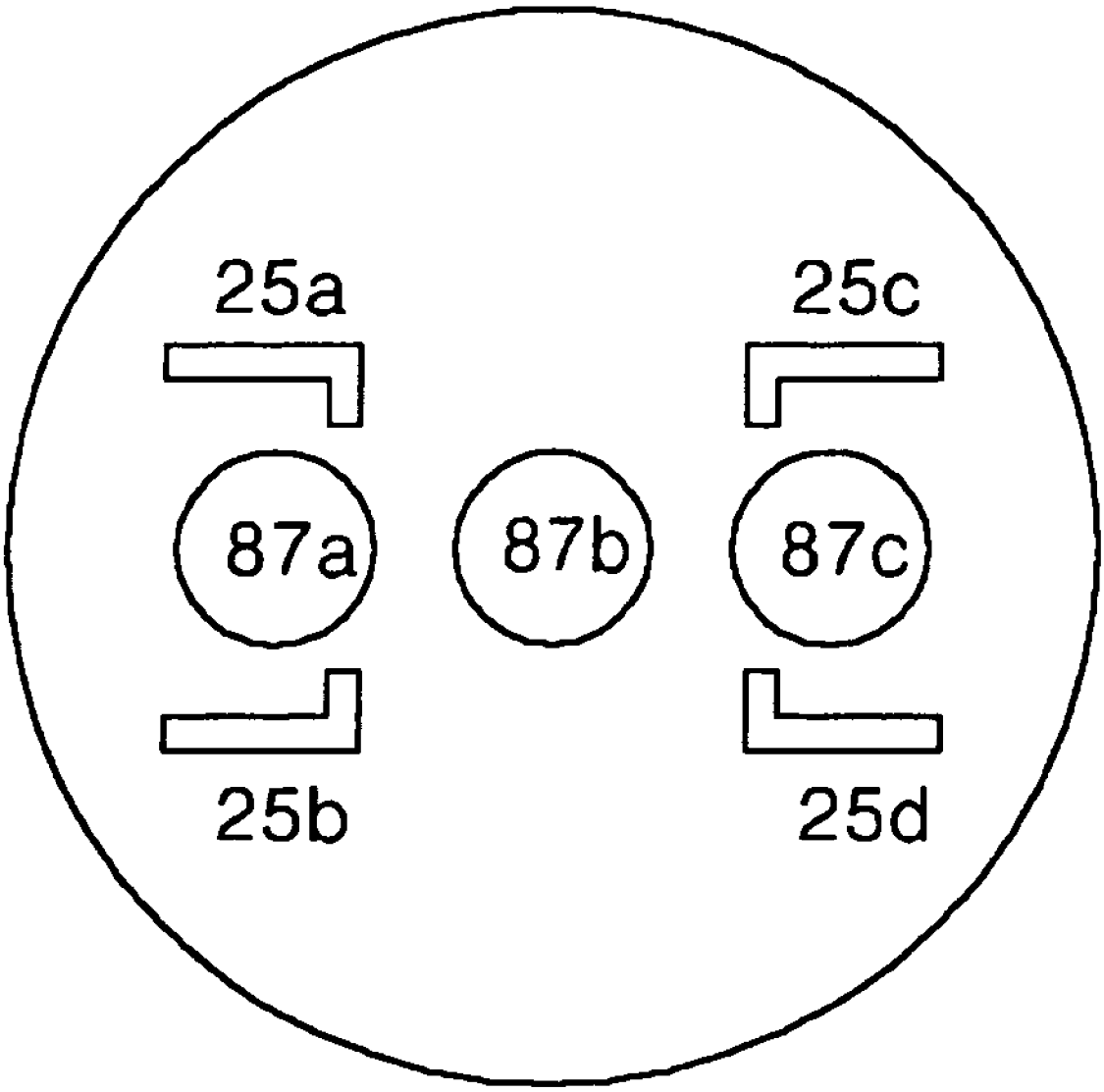
FIG. 10 illustrates a second embodiment of the present invention.

FIG. 10 illustrates a second embodiment of the present invention. The magnetic pieces 25*a*, 25*b*, 25*c* and 25*d* are a L-shaped, with a first leg parallel with and spaced from the horizontal axis with a predetermined distance. The second leg of the magnetic pieces protrudes towards the horizontal axis and is nearest the center beam passage hole as shown in FIG. 10. The first leg of the magnetic pieces may extend beyond the center of the outer beam passage holes 87*a* and 87*c*.

Figure 11:
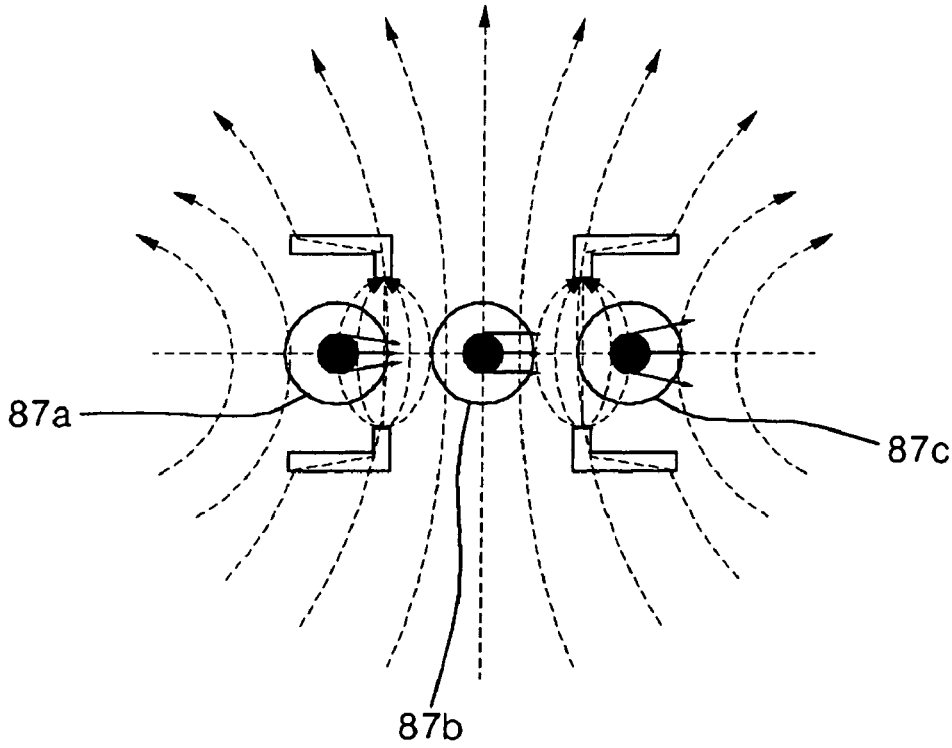
FIG. 11 illustrates the variation of a magnetic field in the second embodiment of the present invention.

Referring to FIG. 11, the barrel type magnetic field is created between the second legs of adjacent magnetic pieces 25*a*–25*b* and 25*c*–25*d*. Because first leg of the magnetic pieces 25 extend beyond the center of the outer beam passage holes 87*a* and 87*c*, the pincushion type magnetic field is suppressed at the outer beam passage holes 87*a* and 87*c*.

Figure 12:
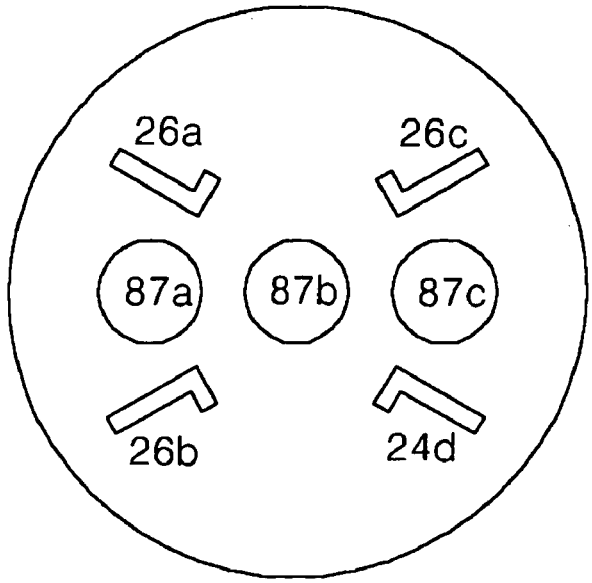
FIG. 12 illustrates a third embodiment of the present invention.

FIG. 12 illustrates a third embodiment of the present invention. The magnetic pieces 26*a*, 26*b*, 26*c* and 26*d* have an L-shape with a first leg tilted with respect to the horizontal axis by 18 to 57 degrees. The second leg of the magnetic pieces extend away from the outer beam passage holes 87*a* and 87*c*. The magnetic pieces may be tilted so that a barrel type magnetic field is formed to remove the haze phenomenon and overcome convergence problem as well. In addition, it is desirable to have the magnetic pieces 26 extend beyond the center of the outer beam passage holes 87*a* and 87*c*.

Figure 13:
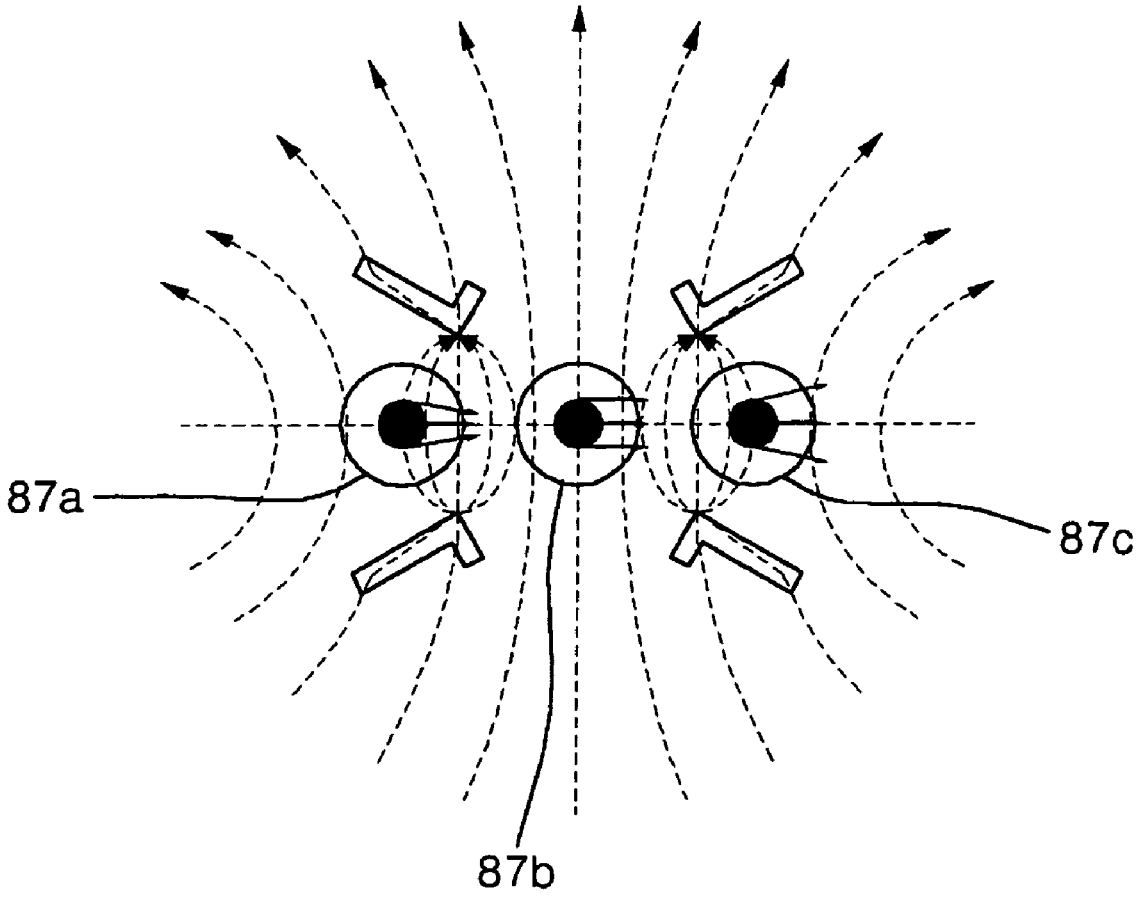
FIG. 13 illustrates the variation of a magnetic field in the third embodiment of the present invention.

As shown in FIG. 13, a barrel magnetic field is created between the upper and lower magnetic pieces 26*a*, 26*c* and 26*b*, 26*d* respectively. The barrel magnetic field emanates from the magnetic pieces 26 where the first and second legs intersect. The first leg of the magnetic pieces suppresses the pin-cushion magnetic field of the outer beam passage holes 87*a* and 87*c*. Accordingly, the red electron beam is prevented from being over-converged when deflected to the right side of the screen. The blue electron beam is prevented from being not converged enough when deflected to the right side of the screen. The red electron beam is prevented from being not converged enough when deflected to the left side of the screen. The blue electron beam is prevented from being over-converged when deflected to the left side of the screen.

Figure 14:
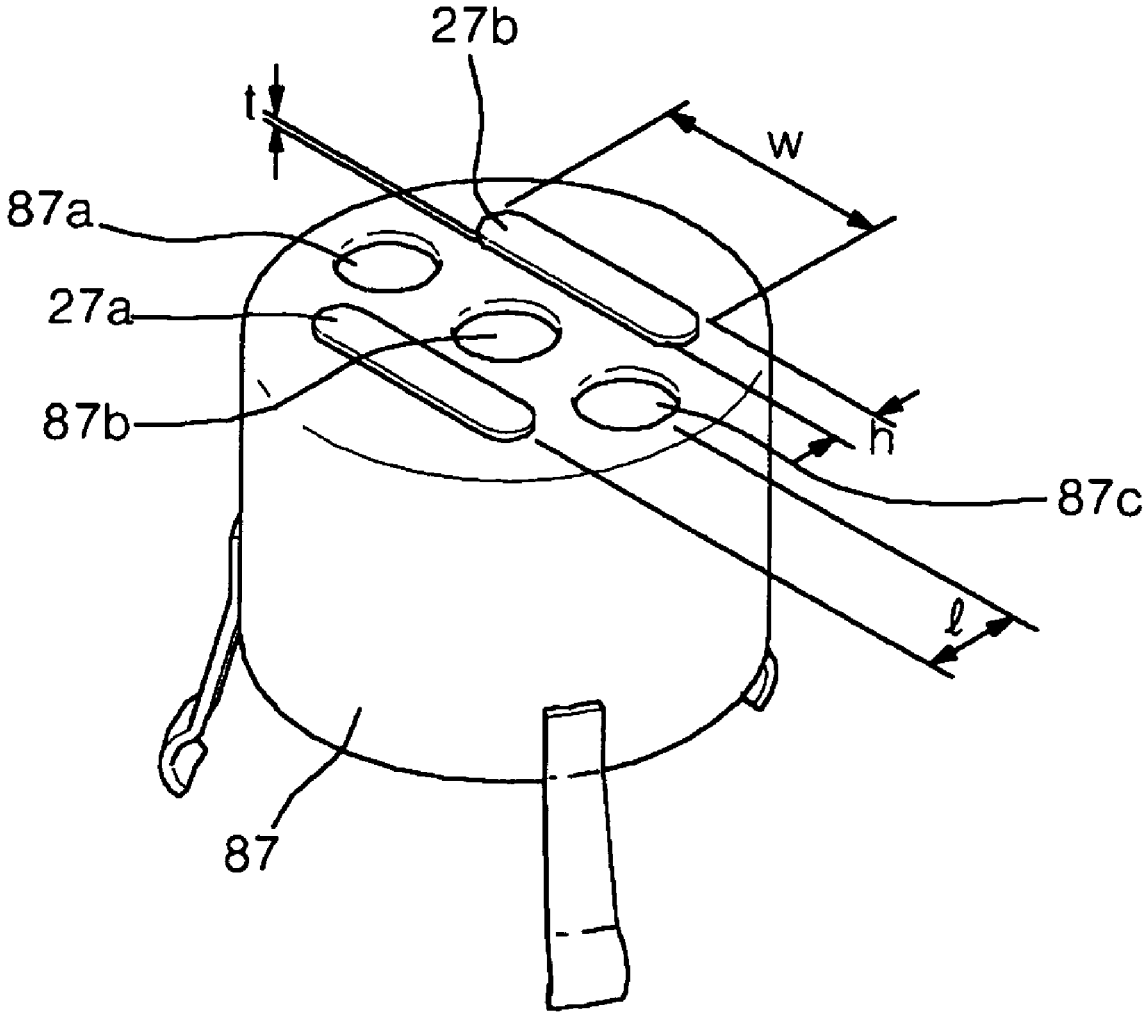
FIG. 14 illustrates a fourth embodiment of the present invention.

FIG. 14 illustrates a fourth embodiment of the present invention in which bar-shaped magnetic pieces 27*a* and 27*b* are formed on the shield cup 87. The three electron beam passage holes 87*a*, 87*b* and 87*c* are arranged inline. The bar-shaped magnetic pieces 27*a* and 27*b* are arranged above and below the electron beam passage holes 87.

The bar-shaped magnetic pieces 27*a* and 27*b* may be 4 to 11 mm wide (w), 1 to 5 mm high (h) and 0.1 to 3.0 mm thick (t), and the center of the bar-shaped magnetic pieces 27*a* and 27*b* may be located at a distance of l=2.5 to 4.5 mm above and below of a center line of the electron beam passage holes 87. In addition, the ends of the bar-shaped magnetic piece 27*a* and 27*b* may or may not extend beyond the center line of the outer beam passage holes 87*a* and 87*c*. The ends of the bar-shaped magnetic piece 27*a* and 27*b* may have a round shape so that the compensating magnetic field mainly affects the R and B electron beams.

Figure 1:
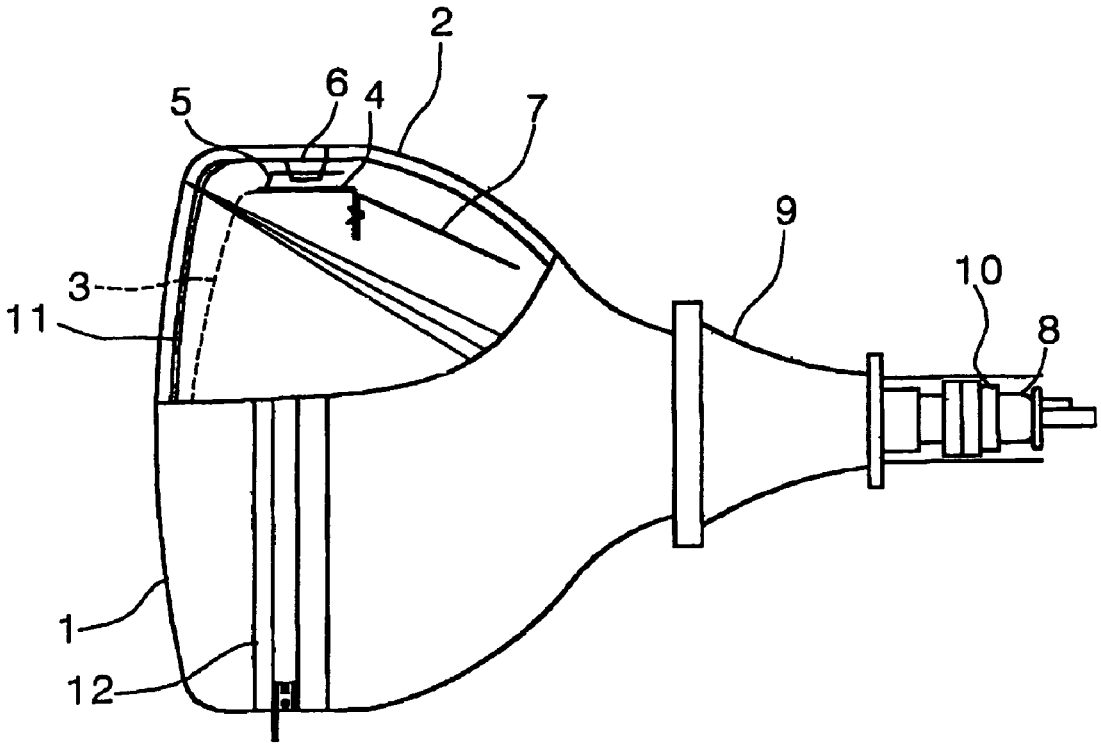
FIG. 1 (Related Art)
FIG. 1 illustrates a configuration of a color cathode ray tube according to the related art.
Figure 2:
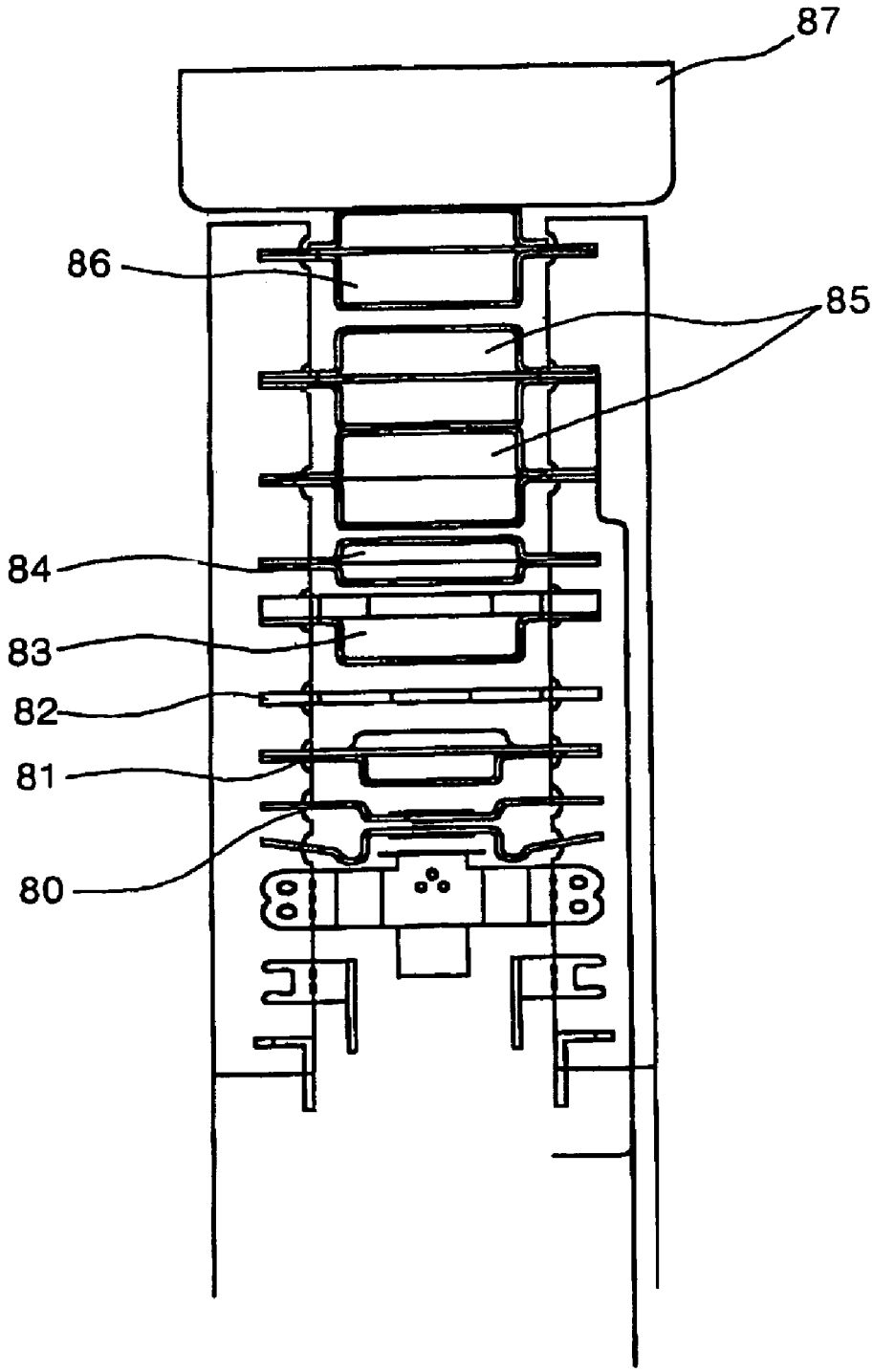
FIG. 2 (Related Art)
FIG. 2 illustrates configuration of an electron gun according to the related art.
Figure 3:
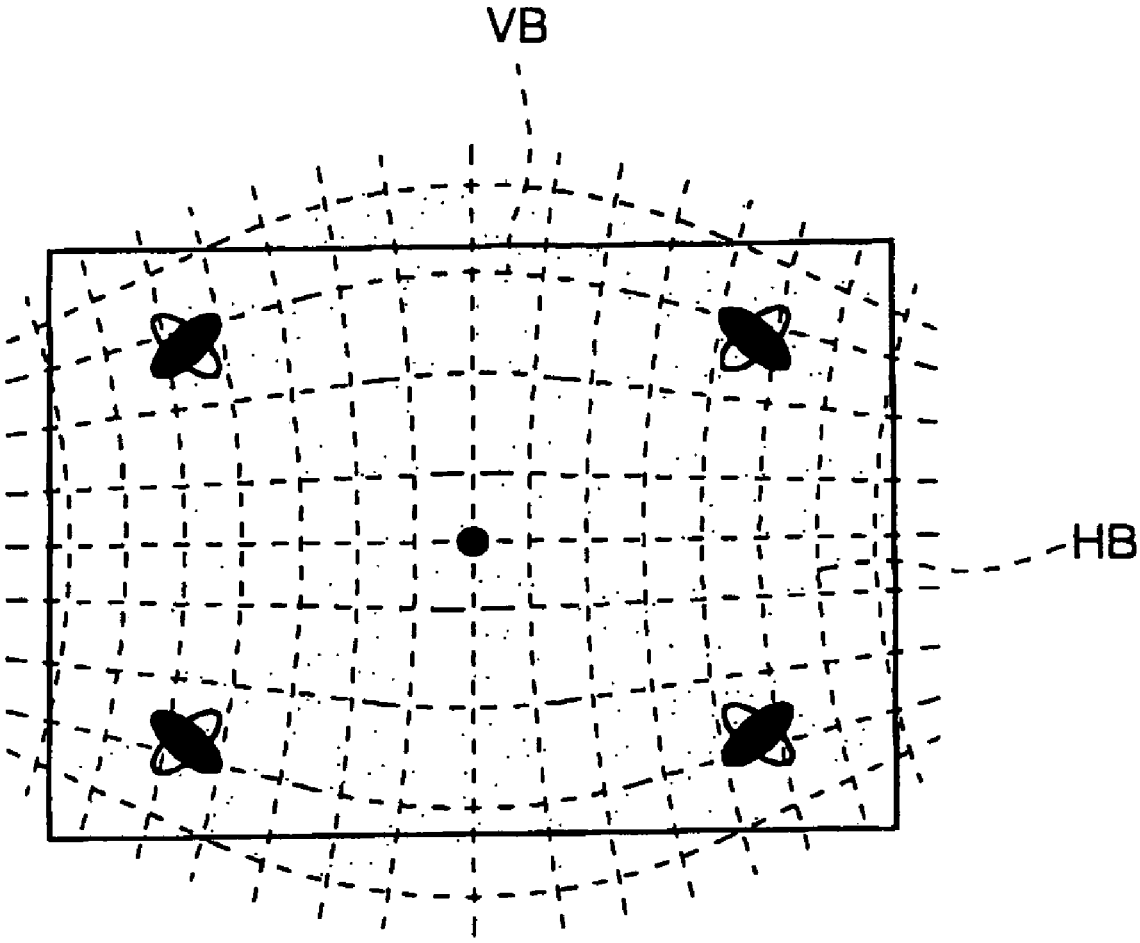
FIG. 3 (Related Art)
FIG. 3 illustrates a self-convergence magnetic field.
Figure 4:
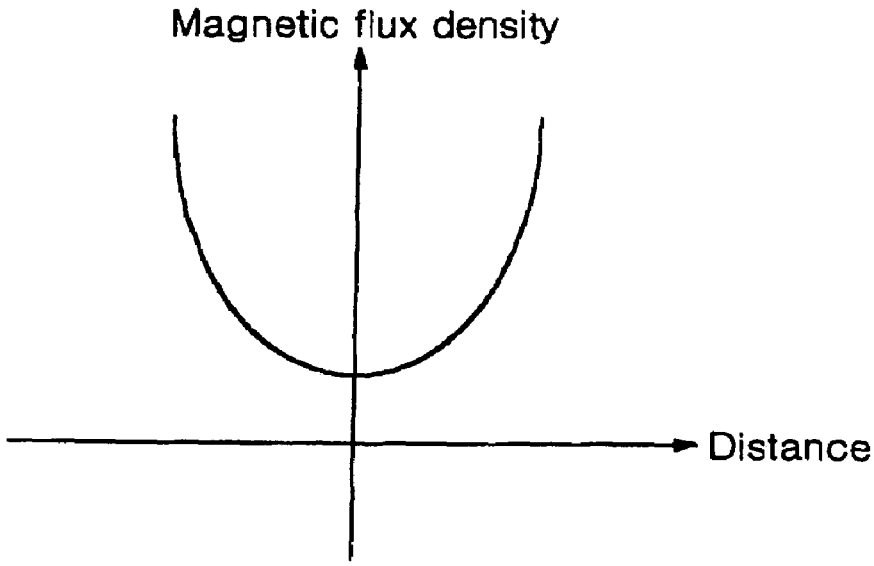
FIG. 4 (Related Art)
FIG. 4 illustrates the variation of magnetic flux density of a magnetic field created by a deflection yoke.
Figure 5:
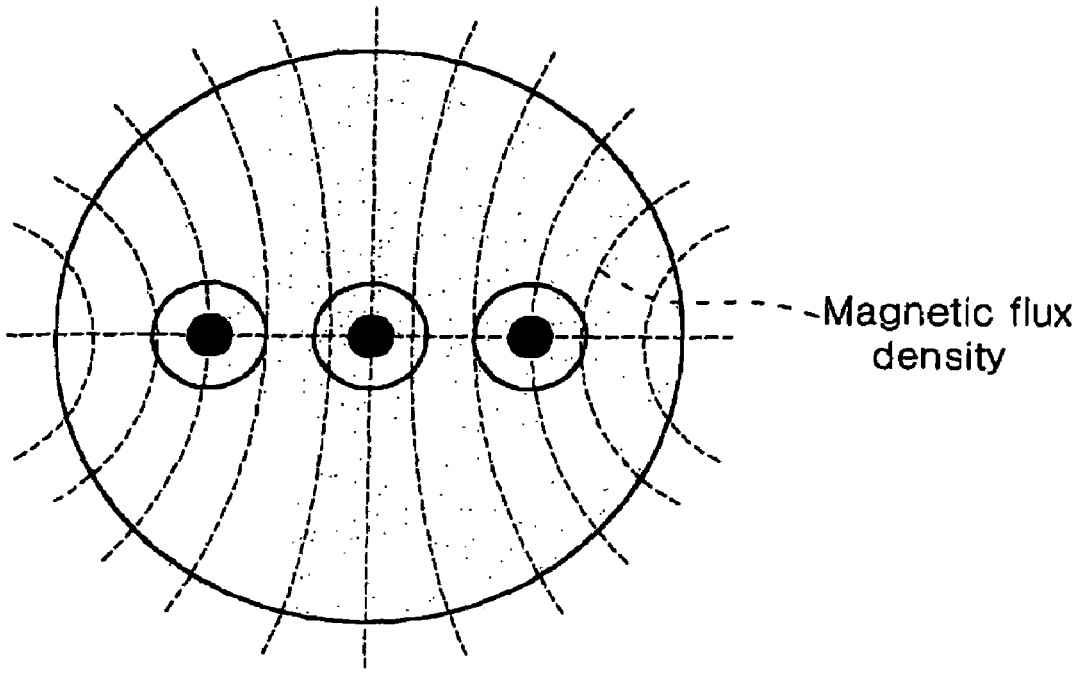
FIG. 5 (Related Art)
FIG. 5 illustrates a pin-cushion type horizontal deflection magnetic field.

In the electron gun configured as described above and a color cathode ray tube including such electron gun, if a predetermined voltage is applied to the cathode ray tube and the electron gun, the three electron beams, i.e., the R, G and B electron beams emitted from the cathode, pass through the lens between the electrodes of the electron gun, and the beams are converged and accelerated to then be deflected by a deflection yoke to scan the electron beams on the fluorescent screen. To deflect the electron beam emitted from the electron gun, the deflection magnetic field created by the deflection yoke includes a barrel magnetic field for deflecting the electron beams vertically and a pincushion magnetic field for deflecting the electron beams horizontally as shown in FIG. 3. Because the bar-shaped magnetic pieces 27*a* and 27*b* are attached to the shield cup 87, the pin-cushion type magnetic field for deflecting the R and B electron beams horizontally is changed to a barrel magnetic field to compensate for the distortion of the electron beams.

Figure 7:
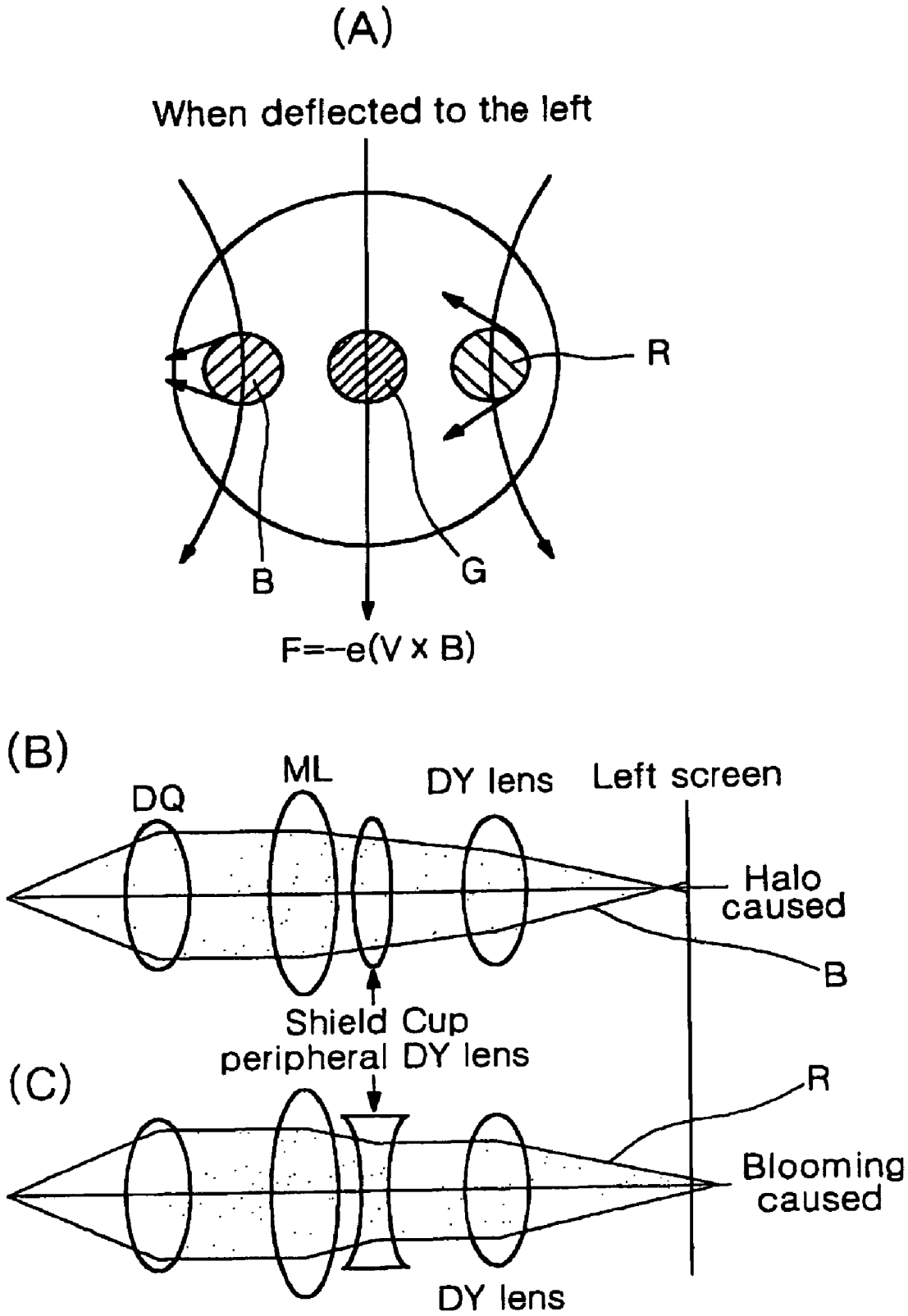
FIG. 7 (Related Art)
FIGS. 7*a*, 7*b* and 7*c* illustrate that the cross-sections of a screen wherein R and B electron beams on both edges of a screen wherein R, G and B electron beams arranged inline are distorted.

In other words, as shown in FIG. 7 described above, the R electron beam and B electron beam which pass the pin-cushion magnetic field, i.e., horizontal deflection magnetic field, are distorted by convergent force and divergent force respectively. The bar-shaped magnetic pieces 27*a* and 27*b* are installed above and below the R electron beam passage hole 87*c* and B electron beam passage hole 87*a* and create a barrel horizontal deflection field that applies a divergent force and a convergent force to the B electron beam and the R electron beam respectively in a direction opposite to the direction of the pin-cushion magnetic field. So, the distortion of the electron beams is compensated.

Figure 15:
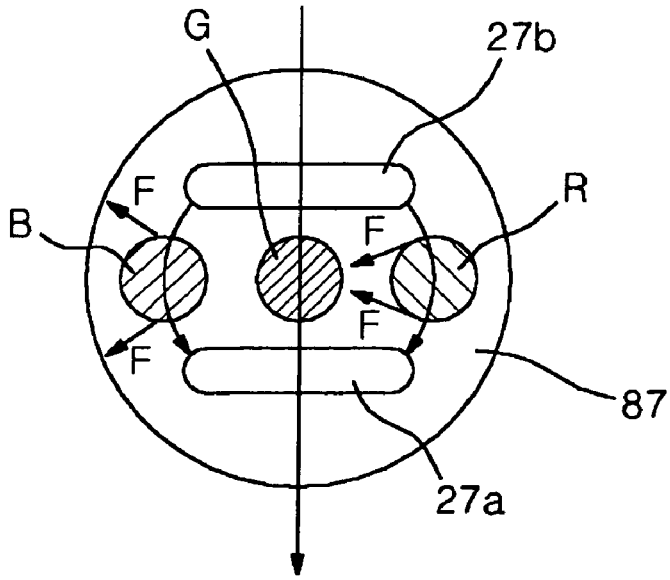
FIG. 15 illustrates that the deflection distortion of electron beams along the periphery is compensated for in the fourth embodiment of the present invention.

In addition, as shown in FIG. 7, because the electron beam is distorted by the deflection magnetic field and a left focus voltage of an outer electron beam becomes different from a right focus voltage the other outer electron beam, a dynamic focus voltage is applied to each of the three electron guns in order to best dynamically focus the three electron beams on the periphery of the screen. However, in a configuration with inline electron guns in which the three electron beam passage holes 87*a*, 87*b* and 87*c* are formed from one electrode, the focus of the R and B electron beams deteriorates as shown in FIG. 7 in a self-convergence deflection magnetic field because the three electron beams are deflected simultaneously. However, because the coma correction unit that uses the bar-shaped magnetic pieces 27*a* and 27*b* compensates for the deflection distortion of the surrounding electron beams as shown in FIG. 15, the difference between the left and right focus voltages may be reduced.

Figure 16:
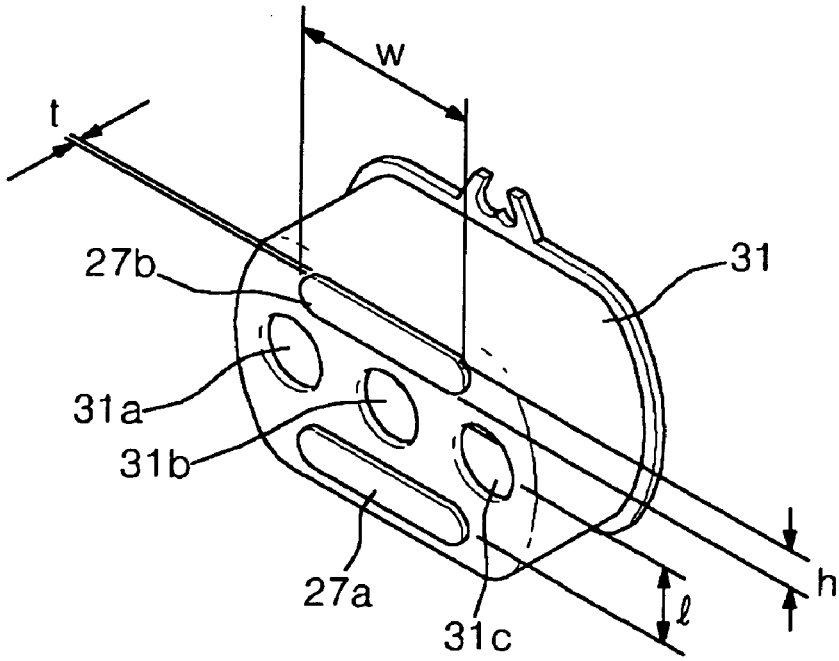
FIG. 16 illustrates a fifth embodiment of the present invention.

FIG. 16 illustrates a fifth embodiment of the present invention in which the bar-shaped magnetic pieces 27 are installed on the electrodes. In other words, R, G and B electron beam passage holes 31*a*, 31*b* and 31*c* are provided on the selected electrode 31 and are arranged inline. The bar-shaped magnetic pieces 27 are arranged above and below the electron beam passage holes 31*a*, 31*b* and 31*c*. The width (w) of the bar-shaped magnetic pieces 27 may be such that the bar-shaped magnetic pieces 27 extend to or beyond the outer electron passage holes 31*a* and 31*c*.

The bar-shaped magnetic pieces 27 may be 4 to 11 mm wide (w), 1 to 5 mm high (h) and 0.1 to 3.0 mm thick (t), and the center of the bar-shaped magnetic pieces 27*a* and 27*b* may be located at a distance of l=2.5 to 4.5 mm above and below a center line of the electron beam passage holes 31*a*, 31*b*, and 31*c*. In addition, the ends of the bar-shaped magnetic piece 27*a* and 27*b* may or may not extend beyond the center line of the outer beam passage holes 31*a* and 31*c*. The ends of the bar-shaped magnetic piece 27*a* and 27*b* may have a round shape so that the compensating magnetic field mainly affects the R and B electron beams.

Figure 17:
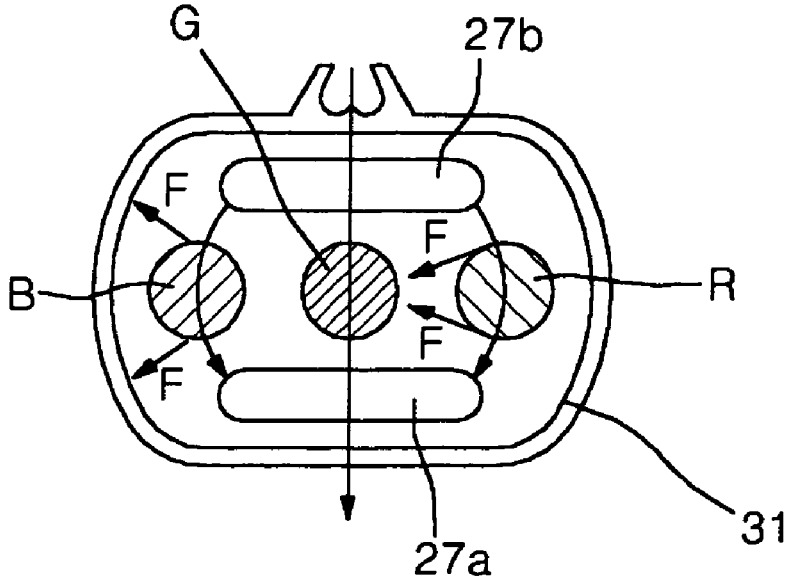
FIG. 17 illustrates that the deflection distortion of electron beams along the periphery is compensated for in the fifth embodiment of the present invention.

In the electron gun configured as described above and a color cathode ray tube including an electron gun, if a predetermined voltage is applied to the cathode ray tube and the electron gun, the three electron beams, i.e., the R, G and B electron beams emitted from the cathode, pass through the lens between the electrodes of the electron gun, and the beams are converged and accelerated to then be deflected by a deflection yoke to scan the electron beams on the fluorescent screen. To deflect the electron beam emitted from the electron gun, the deflection magnetic field created by the deflection yoke includes a barrel magnetic field for deflecting the electron beams vertically and a pincushion magnetic field for deflecting the electron beams horizontally as shown in FIG. 3. Because bar-shaped magnetic pieces 27*a* and 27*b* are attached to the electrode 31, the pin-cushion type magnetic field for deflecting the R and B electron beams horizontally is changed to a barrel magnetic field to compensate for the distortion of the electron beams as shown in FIG. 17.

In addition, as shown in FIG. 7, because the electron beam is distorted by the deflection magnetic field and a left focus voltage of an outer electron beam becomes different from a right focus voltage the other outer electron beam, a dynamic focus voltage is applied to each of the three electron guns in order to best dynamically focus the three electron beams on the periphery of the screen. However, in a configuration with inline electron guns in which the three electron beam passage holes 31*a*, 31*b* and 31*c* are formed from one electrode, the focus of the R and B electron beams deteriorates as shown in FIG. 7 in a self-convergence deflection magnetic field because the three electron beams are deflected simultaneously. However, because the coma correction unit that uses the bar-shaped magnetic pieces 27*a* and 27*b* compensates for the deflection distortion of the surrounding electron beams as shown in FIG. 17, the difference between the left and right focus voltages can be reduced.

The effect of the bar-shaped magnetic pieces of the electron guns described above may be understood by virtue of the following experiments.

It is possible to design the bar-shaped magnetic pieces to find the best size and location which maximizes the effect of their magnetic flux by changing their size (width w, height h and thickness t) and location.

For this experiment, a nickel alloy containing 47 to 51% nickel by weight is employed for a magnetic piece with a thickness of 0.25 mm and a height of 2.0 mm. The experiment is performed varying the location and the width of the magnetic piece.

The result of repeated experiments shows that unbalance between the dynamic focus voltage of the R and B electron beams is smallest at the location of 3.1 mm from the R, G and B center passage holes 87*a*, 87*b* and 87*c* and a width of 8.0 mm.

Figure 18:
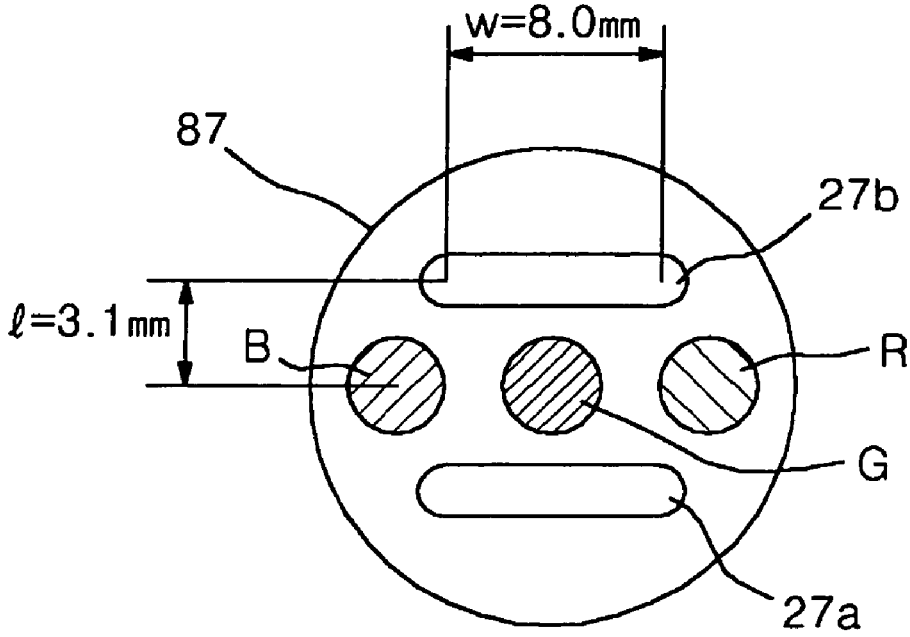
FIG. 18 illustrates a shield cup and a bar-shaped magnetic piece according to the present invention.

FIG. 18 illustrates a shield cup 87 and bar-shaped magnetic pieces 27*a* and 27*b* configured based on the above-mentioned experimental result. Tables 1 and 2 show examples of the experiment data.

TABLE 1

| | Voltage of left peripheral portion | Voltage of center portion | Voltage of right peripheral portion | Voltage of left-right portion |
|---|---|---|---|---|
| R | 7020 V | 6680 V | 7113 V | −93 V |
| G | 7033 V | 6767 V | 7040 V | −7 V |
| B | 7127 V | 6693 V | 7020 V | 107 V |

TABLE 2

| | Voltage of left peripheral portion | Voltage of center portion | Voltage of right peripheral portion | Voltage of left-right portion |
|---|---|---|---|---|
| R | 6983 V | 6647 V | 7050 V | −67 V |
| G | 7023 V | 6740 V | 7010 V | −13 V |
| B | 7070 V | 6660 V | 7003 V | 67 V |

Table 1 shows the results of the experiment and the data before improvement. Table 2 shows the data after improvement for an electron gun that includes a bar-shaped magnetic piece as an aberration correction unit. The dynamic focus voltage of the peripheral R and B electron beams is 107 V at the maximum before improvement (Table 1) while the dynamic focus voltage of the peripheral R and B electron beams is 67 V at a maximum after improvement (Table 2). This is an improvement of 40% for the focus characteristic.

The electron gun according to the present invention prevents the haze phenomenon of the red and blue electron beams on the left and the right of the sides of screen caused by the self-convergence deflection magnetic field.

The electron gun according to the present invention improves the resolution because the three electron beams are converged on the entire screen with the same intensity.

The electron gun according to the present invention may improve the unbalance of the dynammic focus voltage of the peripheral R and B electron beams by about 40% by attaching magnetic pieces to the shield cup of an electron gun or other electrodes.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A electron gun for a color cathode ray tube comprising:

a cathode that emits electron beams;

a plurality of electrodes arranged from the cathode towards a screen of the cathode ray tube; and a shield cup, wherein the shield cup further comprises:

a central electron beam hole;

two outer electron beam holes wherein the central and outer beam holes are substantially collinear along a horizontal axis; and first, second, third, and fourth magnetic pieces;

wherein the first and second magnetic pieces are adjacent to a first outer electron beam hole and on opposite sides of the horizontal axis; and wherein the third and fourth magnetic pieces are adjacent to a second outer electron beam hole and on opposite sides of the horizontal axis; and wherein a first distance l' is defined as the distance between the center of the central electron beam hole and the first end of the magnetic pieces along the horizontal axis, a second distance l is defined as the distance between the center of the central electron beam hole and the center of the outer electron beam holes; and the electron beam holes and magnetic pieces are arranged so that l'/l greater than or equal to 0.5 and less than or equal to 1.0.

2. The electron gun of claim 1, wherein the magnetic pieces have a first and a second end, wherein the first ends are closer to the central electron beam hole than the second end, and wherein the first ends are closer to the horizontal axis than the second ends.

3. The electron gun of claim 2, wherein the magnetic pieces are substantially rectangular.

4. The electron gun of claim 2, wherein the magnetic pieces are slanted in the range of 18 to 57 degrees with respect to the horizontal axis.

5. The electron gun of claim 2, wherein the magnetic pieces are slanted in the range of 20 to 23 degrees with respect to the horizontal axis.

6. The electron gun of claim 2, wherein the magnetic pieces are L-shaped and wherein the magnetic pieces have a first leg between the first and second ends of the magnetic piece and a second leg attached to the first leg at the second end and the second leg extends away from the horizontal axis.

7. The electron gun of claim 6, wherein the magnetic pieces are slanted in the range of 18 to 57 degrees with respect to the horizontal axis.

8. The electron gun of claim 6, wherein the magnetic pieces are slanted in the range of 20 to 23 degrees with respect to the horizontal axis.

9. The electron gun of claim 1, wherein the magnetic pieces are substantially L-shaped with a first and second leg, wherein the first leg is substantially parallel with the horizontal axis with a first and a second end and the first end is closer to the central electron beam hole, wherein the second leg is attached to the first end of the first leg and extends toward the horizontal axis.

* * * * *